US011128948B2

(12) United States Patent
Lee et al.

(10) Patent No.: US 11,128,948 B2
(45) Date of Patent: Sep. 21, 2021

(54) HYBRID SPEAKER

(71) Applicants: BSE Co., Ltd., Incheon (KR); EAR BRIDGE CO., LTD, Incheon (KR)

(72) Inventors: Wontaek Lee, Incheon (KR); Jongman Kim, Bucheon-si (KR); Daein Han, Incheon (KR); Bongrok Choi, Incheon (KR)

(73) Assignees: BSE Co., Ltd., Incheon (KR); EAR BRIDGE CO., LTD, Incheon (KR)

( * ) Notice: Subject to any disclaimer, the term of this patent is extended or adjusted under 35 U.S.C. 154(b) by 0 days.

(21) Appl. No.: 16/652,262

(22) PCT Filed: Jul. 16, 2018

(86) PCT No.: PCT/KR2018/008031
§ 371 (c)(1),
(2) Date: Mar. 30, 2020

(87) PCT Pub. No.: WO2019/098487
PCT Pub. Date: May 23, 2019

(65) Prior Publication Data

US 2020/0245058 A1 Jul. 30, 2020

(30) Foreign Application Priority Data

Nov. 20, 2017 (KR) ..... 10-2017-0155045

(51) Int. Cl.
*H04R 1/26* (2006.01)
*H04R 9/02* (2006.01)
*H04R 9/06* (2006.01)

(52) U.S. Cl.
CPC ..... *H04R 1/26* (2013.01); *H04R 9/025* (2013.01); *H04R 9/06* (2013.01)

(58) Field of Classification Search
CPC . H04R 1/26; H04R 9/025; H04R 9/06; H04R 1/24; H04R 7/18; H04R 7/12; H04R 9/043; H04R 2400/11
(Continued)

(56) References Cited

U.S. PATENT DOCUMENTS 4,418,248 A * 11/1983 Mathis ..... H04R 1/26 381/190
2016/0381460 A1* 12/2016 Chiang ..... H04R 7/125 381/426
2019/0268688 A1* 8/2019 Yoo ..... H04R 9/046

FOREIGN PATENT DOCUMENTS

JP 4006636 B2 5/2004
KR 10-0519637 B1 10/2003
(Continued)

OTHER PUBLICATIONS

International Search Report issued in counterpart PCT application No. PCT/KR2018/008031, dated Oct. 19, 2018, 10 pp.

*Primary Examiner* — Alexander Krzystan
*Assistant Examiner* — Julie X Dang
(74) *Attorney, Agent, or Firm* — Kaplan Breyer Schwarz, LLP

(57) ABSTRACT

The present invention relates to a hybrid speaker, having a high-frequency tweeter and a low-frequency woofer formed on the same axis, for improving sound quality by separately emitting a high-frequency sound generated by the high-frequency tweeter and a low-frequency sound generated by the low-frequency woofer. A device according to the present invention comprises: a woofer part for generating a low-frequency sound; a tweeter part for generating a high-frequency sound; a substrate for supplying an electrical signal to coils of the woofer part and the tweeter part; a lower frame for accommodating constituent components on the same axis; and an upper frame coupled to the lower
(Continued)

frame to form a speaker housing, and separately having a low-frequency sound emission port for emitting the low-frequency sound of the woofer part and a high-frequency sound emission port for emitting the high-frequency sound of the tweeter part. Since the hybrid speaker, according to the present invention, has a hybrid structure in which the high-frequency tweeter and the low-frequency woofer formed on the same axis are coupled, and the high-frequency tweeter and the low-frequency woofer have respective sound emission ports, performance can be maximized, and since a frame of the high-frequency tweeter can be used instead of a low-frequency woofer cover, a process can be simplified, and thus productivity can be increased.

3 Claims, 4 Drawing Sheets

(58) Field of Classification Search
USPC ..... 381/412, 420, 409, 186, 188, 195, 205, 381/88, 182, 335, 342
See application file for complete search history.

(56) References Cited

FOREIGN PATENT DOCUMENTS

| | | |
|---|---|---|
| KR | 10-1501898 B1 | 3/2015 |
| KR | 10-1596894 B1 | 2/2016 |
| KR | 10-1760291 B1 | 7/2017 |

* cited by examiner

[fig. 1]
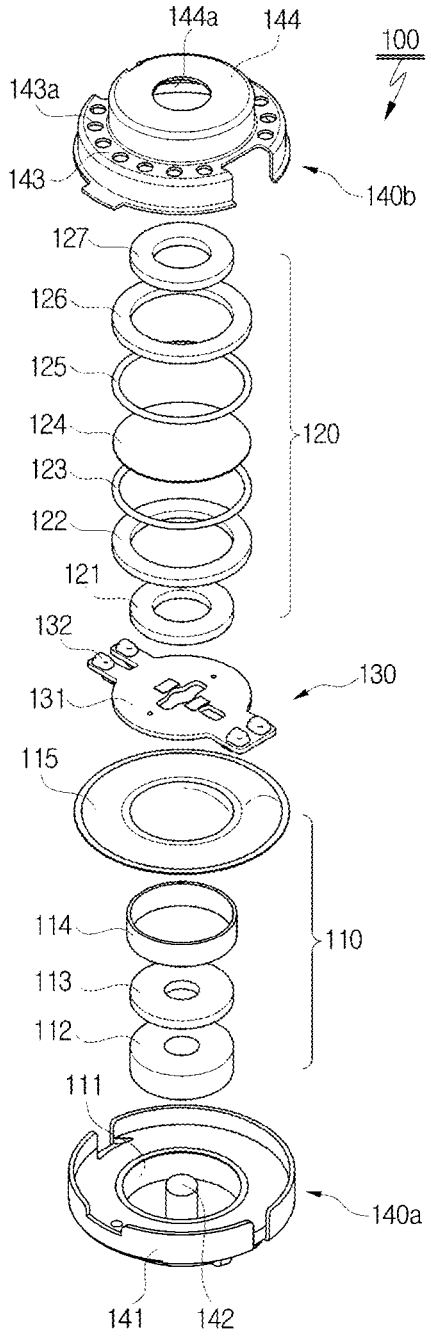

[fig. 2]
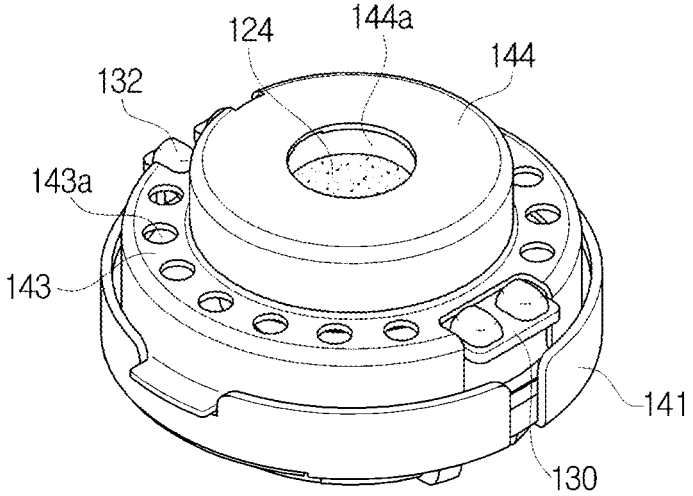
[fig. 3]
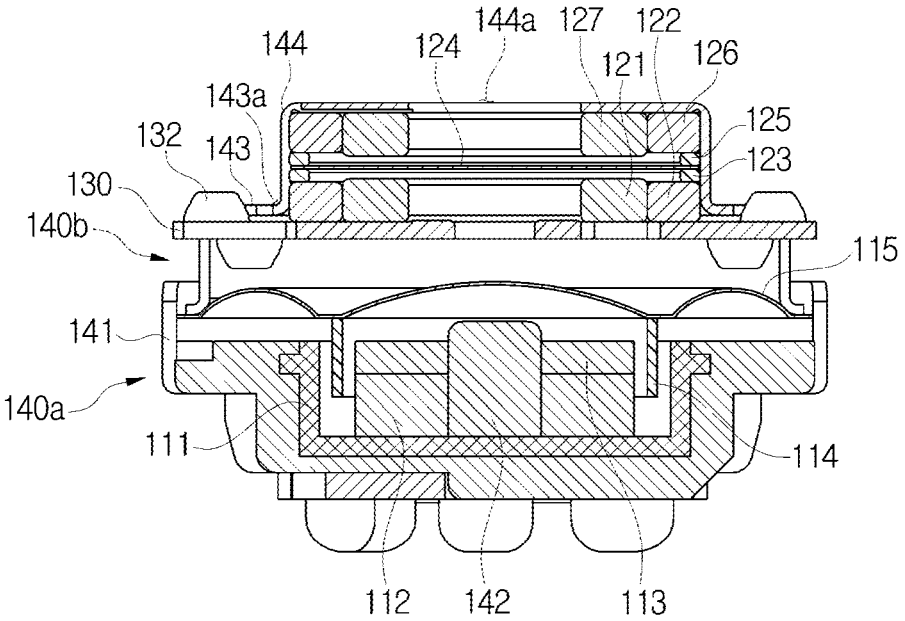

[fig. 4]
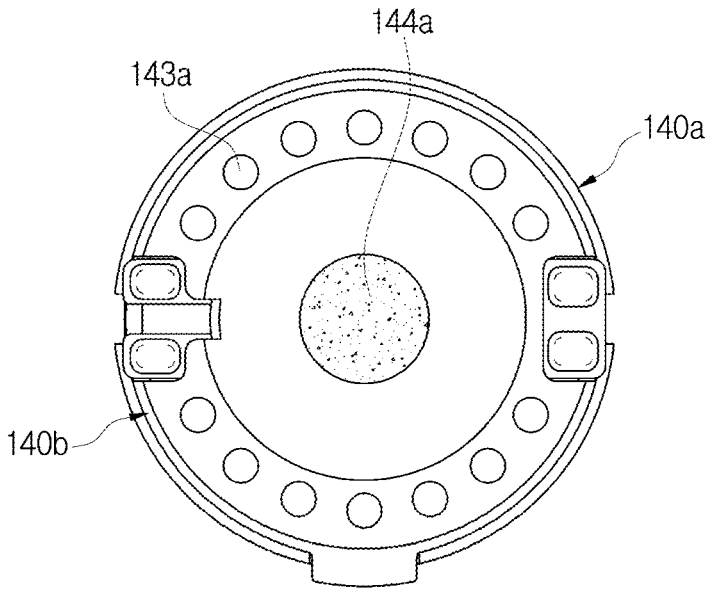
[fig. 5]
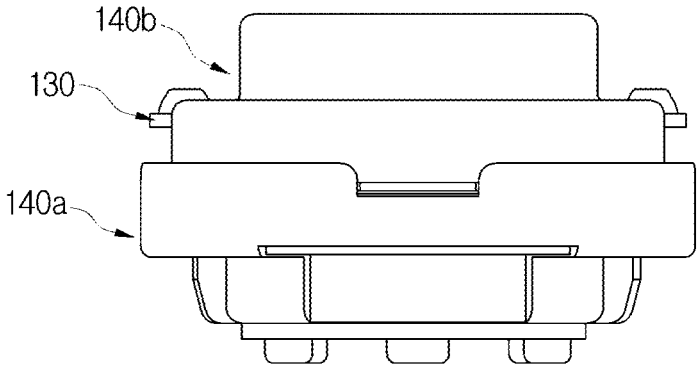

[fig. 6]
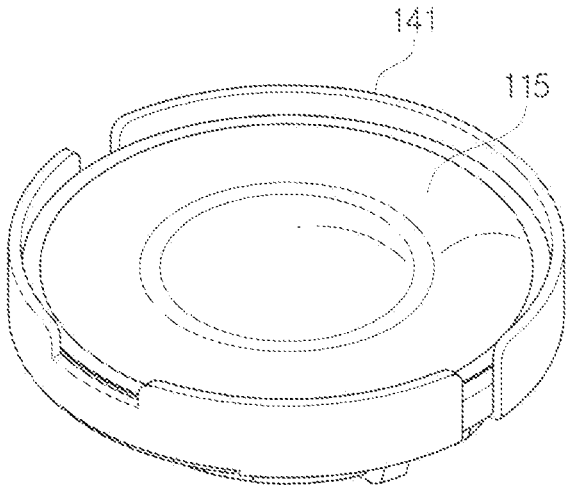
[fig. 7]
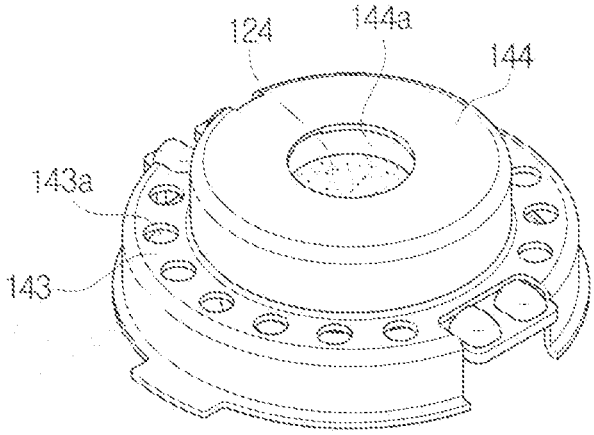
[fig. 8]
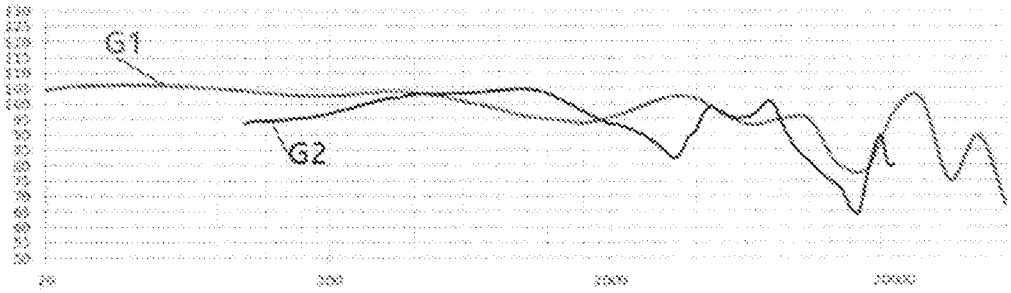

HYBRID SPEAKER

TECHNICAL FIELD

The present invention relates to a speaker, and more particularly, to a hybrid speaker which includes a tweeter of a high-frequency range and a woofer of a low-frequency range on the same axis and improves sound quality by separately discharging a high-frequency sound generated by the tweeter of the high-frequency range and a low-frequency sound generated by the woofer of the low-frequency range.

BACKGROUND ART

Generally, speakers are classified, according to principles and methods of converting electrical signals into sound waves, into a dynamic speaker, an electromagnetic speaker, a static speaker, a dielectric speaker, a magnetostrictive speaker, and the like. Dynamic speakers, which are most generally used, use a principle that when a voice signal current is applied to a (voice) coil in a magnetic field of a magnet, a mechanical force acts on the coil to initiate a movement according to intensity of the current. Also, speakers are often classified into a radiative speaker having a diaphragm directly disposed in the air and a horn speaker having a diaphragm disposed in a horn.

Meanwhile, a magnetic speaker operated by vibrations of an armature of a magnetic body is referred to as a balanced armature (BA) speaker. In an armature speaker, armatures disposed above and below coils inside a metal case keep a balance among the coils and float without being attached to any side due to magnets present with the coils. Here, when a current flows through the inside coils, the coils are magnetized such that the armatures having metallic materials vibrate according to magnetic forces and vibrations are transferred to a diaphragm (vibrating plate) through a thin rod. Ultimately, the diaphragm vibrates and generates a sound. Generally, as a material of a diaphragm, a 100% metal plate, or a variety of materials such as metal coated with plastic, a plastic plate, and the like are used. Since such BA speakers are drivers invented for hearing aids, they have a small size and a light weight.

Among electromagnetic speakers, a plate type speaker has a fast reaction property of very faithfully responding to a micro signal of a supplied electrical signal since an additional secondary vibration transfer element is unnecessary and a vibrating plate is capable of reproducing a sound wave by directly vibrating air. As the plate type speaker, Korean Patent Registration No. 1596894 discloses a balanced plate type electromagnetic speaker.

The electromagnetic speaker includes an upper coil, a lower coil disposed below the upper coil, a diaphragm disposed between the upper coil and the lower coil, one or more magnets disposed outside the upper coil and the lower coil, an upper damping member supporting a top surface of the diaphragm and a lower damping member supporting a bottom surface of the diaphragm. In the conventional electromagnetic speaker, when a current flow is zero, the diaphragm is neutralized and is located in a center due to a balance between upper and lower magnetic fields of the upper and lower magnets and a restoring force of the diaphragm. When the current flow is in a positive cycle, an internal magnetic field direction of the upper coil and an internal magnetic field direction of the lower coil are internally symmetrical to each other such that the diaphragm is N-polarized and moves in an upward direction. When the current flow is in a negative cycle, the internal magnetic field direction of the upper coil and the internal magnetic field direction of the lower coil are externally symmetrical to each other such that the diaphragm is S-polarized and moves in a downward direction. However, in the conventional electromagnetic speaker, since one integrated diaphragm in a plane is supported by the upper and lower damping members and a gap guide is provided externally, an amplitude space is necessary as well as efficiency decreasing due to increasing magnetic resistance and a thickness of the speaker increasing. Particularly, conventional electromagnetic speakers have good resolution but generally show limited performance in extension of a low-frequency sound and a super high-frequency sound. Accordingly, speakers having new features for reproducing both a high-frequency sound and a low-frequency sound in higher quality are necessary.

DISCLOSURE

Technical Problem

The present invention is directed to providing a hybrid speaker capable of reducing a loss of sound by separately discharging a high-frequency sound generated by a tweeter of a high-frequency range and a low-frequency sound generated by a woofer of a low-frequency range.

Technical Solution

One aspect of the present invention provides a hybrid speaker in which a low-frequency sound discharge path formed in a low-frequency space of a woofer portion and a high-frequency sound discharge path formed in a high-frequency sound space of a tweeter portion do not overlap each other and are separated from each other.

The hybrid speaker includes the woofer portion implemented as a dynamic speaker in which when a current flows through a low-frequency voice coil disposed on a magnetic circuit, a low-frequency sound diaphragm vibrates and generates a low-frequency sound, the tweeter portion implemented as a plate type electromagnetic speaker in which a magnet and a coil are arranged on each of an upper side and a lower side on the basis of a high-frequency sound diaphragm in a balance state and each coil becomes an electromagnet and generates a high-frequency sound by magnetizing the high-frequency sound diaphragm, a substrate disposed between the woofer portion and the tweeter portion to divide the low-frequency sound space of the woofer portion and the high-frequency sound space of the tweeter portion and to supply an electrical signal to the coil of each of the woofer portion and the tweeter portion, a lower frame configured to accommodate components on the same axis, and an upper frame coupled to the lower frame to form a single-body speaker housing in which a low-frequency sound outlet for discharging the low-frequency sound of the woofer portion and a high-frequency sound outlet for discharging the high-frequency sound of the tweeter portion are separated and discharge the sounds in the same direction.

The lower frame may include a frame body configured to accommodate a yoke and a magnet of the woofer portion and a woofer cover configured to accommodate the low-frequency sound diaphragm and to support the upper frame.

The upper frame may include a low-frequency sound case in which the low-frequency sound outlet configured to discharge the low-frequency sound generated in the low space of the woofer portion from a peripheral part of the speaker housing is formed, and a high-frequency sound case in which the high-frequency sound outlet configured to discharge the high-frequency sound generated in the high-frequency sound space of the tweeter portion from a center of the speaker housing so as to tune the high-frequency sound by adjusting an area or disposition of the low-frequency sound outlet is formed.

Advantageous Effects

According to the present invention, a speaker has a hybrid structure in which a tweeter in a high-frequency range is implemented as a plate type electromagnetic speaker having a favorable high-frequency sound property and a woofer in a low-frequency range is implemented as a dynamic speaker such that the electromagnetic speaker and the dynamic speaker are coupled with each other so as to form an overall thin shape and improve sound properties throughout a low-frequency range and a high-frequency range.

Also, a speaker according to the present invention provides effects of maximizing performance since a tweeter in a high-frequency range and a woofer in a low-frequency range are implemented as a single body on the same axis while sound outlets thereof are separately provided and effects of simplifying a manufacturing process and increasing productivity since a frame of the tweeter in the high-frequency range is replaceable with a cover of the woofer in the low-frequency range.

Also, according to the present invention, there are provided advantages of decreasing an overall volume of a speaker with different sizes of a tweeter in a high-frequency range and a woofer in a low-frequency range and easily tuning a sound in a high-frequency range by adjusting an area, disposition, or the like of a low-frequency sound outlet since the low-frequency sound outlet is separated from a high-frequency sound outlet.

DESCRIPTION OF DRAWINGS

FIG. 1 is an exploded perspective view of a hybrid speaker according to the present invention;

FIG. 2 is a coupled perspective view of the hybrid speaker according to the present invention;

FIG. 3 is a side cross-sectional view of the hybrid speaker according to the present invention;

FIG. 4 is a plan view of the hybrid speaker according to the present invention;

FIG. 5 is a front view of the hybrid speaker according to the present invention;

FIG. 6 is a perspective view illustrating a subassembly of a woofer portion of the hybrid speaker according to the present invention;

FIG. 7 is a perspective view illustrating a subassembly of a tweeter portion of the hybrid speaker according to the present invention; and FIG. 8 is a view illustrating acoustic properties of the hybrid speaker according to the present invention.

MODES OF THE INVENTION

The present invention and the technical aspects achieved by implementing the present invention will be clarified by exemplary embodiments of the present invention which will be described below. The following embodiments are merely examples for describing the present invention and not intended to restrict the scope of the present invention.

FIG. 1 is an exploded perspective view of a hybrid speaker according to the present invention, FIG. 2 is a coupled perspective view of the hybrid speaker according to the present invention, FIG. 3 is a side cross-sectional view of the hybrid speaker according to the present invention, FIG. 4 is a plan view of the hybrid speaker according to the present invention, and FIG. 5 is a front view of the hybrid speaker according to the present invention.

In a hybrid speaker 100 according to the present invention, as shown in FIGS. 1 to 5, a woofer portion 110 having excellent low-frequency sound properties, a tweeter portion 120 having excellent high-frequency sound properties, and a substrate 130 configured to supply an electrical signal to a coil while distinguishing a low-frequency sound space of the woofer portion 110 and a high-frequency sound space of the tweeter portion 120 are integrally coupled on the same axis between a lower frame 140*a* and an upper frame 140*b*.

The woofer portion 110 is a dynamic type speaker including a yoke 111, a low-frequency sound magnet 112, a plate 113, a low-frequency voice coil 114, and a low-frequency sound diaphragm 115, and the tweeter portion 120 is a plate type electromagnetic speaker including a first high-frequency sound coil 121, a first high-frequency sound magnet 122, a first gap guide 123, a high-frequency sound diaphragm 124, a second gap guide 125, a second high-frequency sound magnet 126, and a second high-frequency sound coil 127.

Referring to FIGS. 1 to 3, the lower frame 140*a* includes a frame body 142 and a woofer cover 141. A cylindrical groove is formed in a central part of the frame body 142 to accommodate the cylindrical yoke 111, and an axial column 142*a* protrudes from a center to couple the respective elements on the same axis.

In the woofer portion 110, the magnet 112 and the plate 113 are sequentially stacked inside the yoke 111 and form a cavity between the yoke 111 and the plate 113, and the voice coil 114 is attached to a bottom surface of the low-frequency sound diaphragm 115 and disposed in the cavity. The low-frequency sound diaphragm 115 includes a dome portion in a center and an edge portion on a periphery.

The woofer portion 110 operates as a dynamic speaker in which a magnetic field between the magnet 112 and the yoke 111 interacts with the voice coil 114 and the low-frequency sound diaphragm 115 is vibrated when a current flows through the voice coil 114.

In the tweeter portion 120, the high-frequency sound diaphragm 124 in the center floats in a space due to gap guides 123 and 125 which function as both upper and lower dampers, the first coil 121 and the first magnet 122 are horizontally arranged below the high-frequency sound diaphragm 124, and the second magnet 126 and the second coil 127 are horizontally arranged above the high-frequency sound diaphragm 124. In the embodiment of the present invention, all the magnets 122 and 126 or the coils 121 and 127 have annular shapes. The magnets 122 and 126 are disposed outside the coils 121 and 127. The gap guides 123 and 125 are inserted between the magnets 122 and 126 and the diaphragm 124 and form a space for vibration of the high-frequency sound diaphragm 124.

In the tweeter portion 120 configured as described above, which operates as a plate type electromagnetic speaker, when a current does not flow, the high-frequency sound diaphragm 124 is neutralized and located in a center due to upper and lower magnetic field balance between the first and second magnets 122 and 126 and a restoration force of the diaphragm. When a current flow is on a positive cycle, since internal magnetic field directions of the coils 121 and 127 are inwardly symmetrical to each other and the high-frequency sound diaphragm 124 becomes N-polarized, the high-frequency sound diaphragm 124 moves upward. When a current flow is on a negative cycle, internal magnetic field directions of the coils are outwardly symmetrical to each other and the high-frequency sound diaphragm 124 becomes S-polarized, the high-frequency sound diaphragm 124 moves downward. Here, a magnetization direction may vary according to a magnetic pole array direction of the first magnet 122 and the second magnet 126.

The substrate 130 has a structure in which an electrode pad 132 is formed on a printed circuit board (PCB) 131 and is disposed between the woofer portion 110 and the tweeter portion 120 to divide a low-frequency sound space and a high-frequency sound space and supplies an audio signal current to each of the voice coil 114 of the woofer portion 110 and the first coil 121 and the second coil 127 of the tweeter portion 120.

The upper frame 140*b* includes a low-frequency sound case 143 including a low-frequency sound outlet 143*a* for discharging a low-frequency sound generated in the low-frequency sound space of the woofer portion 110 and a high-frequency sound case 144 including a high-frequency outlet 144*a* for discharging a high-frequency sound generated in a high-frequency sound space of the tweeter portion 120. In the embodiment of the present invention, the low-frequency sound case 143 is formed on a circumferential part, and the high-frequency sound case 144 protrudes from a central part. Also, in the embodiment of the present invention, one high-frequency sound outlet 144*a* is formed in a central part of the high-frequency sound case 144 and a plurality of such low-frequency sound outlets 143*a* are formed on a circumferential part of the low-frequency sound case 143. As described above, in the present invention, since the low-frequency sound outlet 143*a* is separated from the high-frequency sound outlets 144*a*, there is an advantage of being capable of tuning a sound in a high-frequency range by adjusting an area, disposition, and the like of the low-frequency sound outlet.

Also, in the embodiment of the present invention, an area of the low-frequency sound outlet is 50% to 100% on the basis of an area of the high-frequency sound outlet as a ratio between areas of the high-frequency sound outlet and the low-frequency sound outlet, and when a speaker width is referred to as W and a speaker thickness is referred to as T, a distance D between a center of the high-frequency sound outlet and a center of the low-frequency sound outlet is about D=4.5 W/T.

FIG. 6 is a perspective view illustrating a subassembly of the woofer portion of the hybrid speaker according to the present invention, FIG. 7 is a perspective view illustrating a subassembly of the tweeter portion of the hybrid speaker according to the present invention, and FIG. 8 is a view illustrating acoustic properties of the hybrid speaker according to the present invention.

When an audio signal is applied from the outside to the substrate 130 of the hybrid speaker according to the present invention, an audio current flows through the voice coil 114 of the woofer portion. When a current flows through the voice coil 114 disposed in a cavity of a magnetic circuit including the magnet 112, the plate 113, and the yoke 111 of the woofer portion 110, a magnetic field is formed along a direction of the current and interacts with the magnetic circuit such that the low-frequency sound diaphragm 115 vertically vibrates and a low-frequency sound of the woofer portion generated by the vibrations of the low-frequency sound diaphragm 115 is discharged outward through the low-frequency sound outlet 143*a* of the upper frame.

Meanwhile, when an audio signal is applied from the external source to the substrate 130 of the hybrid speaker, currents also flow through the first coil 121 and the second coil 127 of the tweeter portion such that the first coil 121 and the second coil 127 operate as electromagnets and interact with the first magnet 122 and the second magnet 126 so as to magnetize the high-frequency sound diaphragm 124. Also, according to a magnetization direction of the high-frequency sound diaphragm 124, the diaphragm 124 vertically vibrates and generates a high-frequency sound of the tweeter portion and the high-frequency sound of the tweeter portion is discharged outward through the high outlet 144*a*.

As described above, the hybrid speaker 100 according to the present invention has a structure in which a woofer subassembly shown in FIG. 6 and the tweeter subassembly shown in FIG. 7 are vertically arranged on the same axis, in which a low-frequency sound generated by the woofer portion 110 is discharged through the low-frequency sound outlet 143*a* and a high-frequency sound generated by the tweeter portion 120 is discharged through the high-frequency sound outlet 144*a* such that a loss in the high-frequency sound may be reduced to improve sound quality.

It may be seen that the acoustic feature of the present invention has been significantly improved as described above in comparison to a conventional structure having one outlet as shown in FIG. 8.

Referring to FIG. 8, G2 is a line illustrating a conventional acoustic property and G1 is a line illustrating an acoustic property according to the present invention. When both the graphs are compared, it may be seen that the speaker of the present invention has an acoustic property improved in a low-frequency sound and a high-frequency sound.

Although one embodiment of the present invention has been described with reference to the drawings, it should be understood by one of ordinary skill in the art that a variety of modifications and equivalents thereof may be made therefrom.

The invention claimed is:

1. A hybrid speaker comprising:

a woofer portion implemented as a dynamic speaker in which when a current flows through a low-frequency voice coil disposed on a magnetic circuit, a low-frequency sound diaphragm vibrates and generates a low-frequency sound;

a tweeter portion implemented as a plate type electromagnetic speaker in which a magnet and a coil are arranged on each of an upper side and a lower side on the basis of a high-frequency sound diaphragm in a balance state and each coil becomes an electromagnet and generates a high-frequency sound by magnetizing the high-frequency sound diaphragm;

a substrate disposed between the woofer portion and the tweeter portion to divide a low-frequency sound space of the woofer portion and a high-frequency sound space of the tweeter portion and to supply an electrical signal to the coil of each of the woofer portion and the tweeter portion;

a lower frame configured to accommodate components on the same axis; and an upper frame coupled to the lower frame to form a single-body speaker housing in which a low-frequency sound outlet for discharging the low-frequency sound of the woofer portion and a high-frequency sound outlet for discharging the high-frequency sound of the tweeter portion are separated and discharge the sounds in the same direction, wherein a low-frequency sound discharge path formed in the low-frequency sound space of the woofer portion and a high-frequency sound discharge path formed in the high-frequency sound space of the tweeter portion do not overlap each other and are separated from each other.

2. The hybrid speaker of claim 1, wherein the lower frame comprises a frame body configured to accommodate a yoke and a magnet of the woofer portion and a woofer cover configured to accommodate the low-frequency sound diaphragm and to support the upper frame.

3. The hybrid speaker of claim 1, wherein the upper frame comprises a low-frequency sound case in which the low-frequency sound outlet configured to discharge the low-frequency sound generated in the low-frequency sound space of the woofer portion from a peripheral part of the speaker housing is formed, and a high-frequency sound case in which the high-frequency sound outlet configured to discharge the high-frequency sound generated in the high-frequency sound space of the tweeter portion to a center of the speaker housing so as to tune the high-frequency sound by adjusting an area or disposition of the low-frequency sound outlet is formed.

* * * * *